US007188441B2

(12) United States Patent
Merten et al.

(10) Patent No.: US 7,188,441 B2
(45) Date of Patent: Mar. 13, 2007

(54) PLOW GUIDE FOR A CHAIN-PULLED PLOW

(75) Inventors: Gerhard Merten, Lunen (DE); Adam Klabisch, Dortmund (DE); Klaus Duhnke, Bochum (DE); Norbert Hesse, Bochum (DE); Gerhard Siepenkort, Lunen (DE); Uwe Tillessen, Kamen (DE); Hans Meya, Werne (DE)

(73) Assignee: DBT GmbH, Lunen (DE)

( * ) Notice: Subject to any disclaimer, the term of this patent is extended or adjusted under 35 U.S.C. 154(b) by 444 days.

(21) Appl. No.: 10/839,484

(22) Filed: May 5, 2004

(65) Prior Publication Data

US 2004/0256907 A1 Dec. 23, 2004

(30) Foreign Application Priority Data

May 7, 2003 (DE) ..... 203 07 150 U

(51) Int. Cl.
*E21C 27/34* (2006.01)
*E21C 35/20* (2006.01)

(52) U.S. Cl. ..... 37/466; 299/43; 299/34.01

(58) Field of Classification Search ..... 37/466; 299/34.04, 42, 47, 43, 34.01, 34.1
See application file for complete search history.

(56) References Cited

U.S. PATENT DOCUMENTS 4,111,489 A * 9/1978 Beckmann et al. ..... 299/34.04
4,391,471 A * 7/1983 Hauschopp et al. ..... 299/43
4,474,411 A * 10/1984 Peters et al. ..... 299/43
4,561,697 A * 12/1985 Hauschopp ..... 299/43
4,607,890 A * 8/1986 Merten et al. ..... 299/43
5,033,604 A * 7/1991 Steinkuhl et al. ..... 198/735.6
5,139,313 A * 8/1992 Fiesel et al. ..... 299/34.1
5,184,873 A * 2/1993 Fiesel ..... 299/43
6,769,742 B2 * 8/2004 Siepenkort ..... 299/34.1

FOREIGN PATENT DOCUMENTS

| | | |
|---|---|---|
| DE | 3012884 | 7/1983 |
| DE | 3244038 | 6/1984 |
| DE | 3627733 | 2/1988 |

* cited by examiner

*Primary Examiner*—Thomas A Beach
(74) *Attorney, Agent, or Firm*—Fay Sharpe LLP

(57) ABSTRACT

The subject matter of the present invention relates to a plow guide for a chain-pulled plow for use in underground mining operations, with plow guide troughs 20 and 50 having multiple parts and being connectable to one another by means of coupling elements so as to be tension-proof and angularly movable. Each plow guide trough has a center piece 21 and 51 with superposed chain guide channels 10C, 10B, 10D, to both sides of which center piece an end piece, 22,23 and 52,53 is joined by welding, which end piece is a single-piece casting with superposed chain channel sections that are separated by a sliding spacer piece that is cast on. To make available a high-performance Gleithobel system with a high tool life, cast-on holding pockets 24,25 and 54, 55—which are open on the working face side—for toggle connections with toggles 1 as coupling organs are disposed on end pieces 22,23 and 52, 53. (FIG. 2)

27 Claims, 4 Drawing Sheets

Fig.4
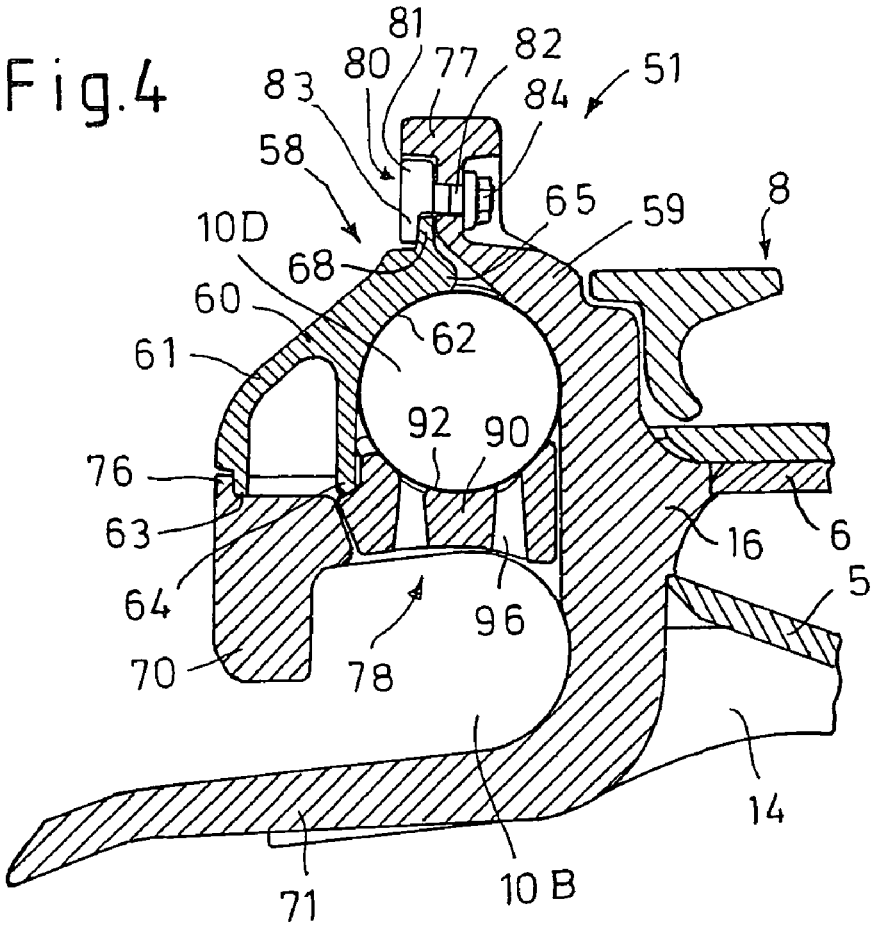
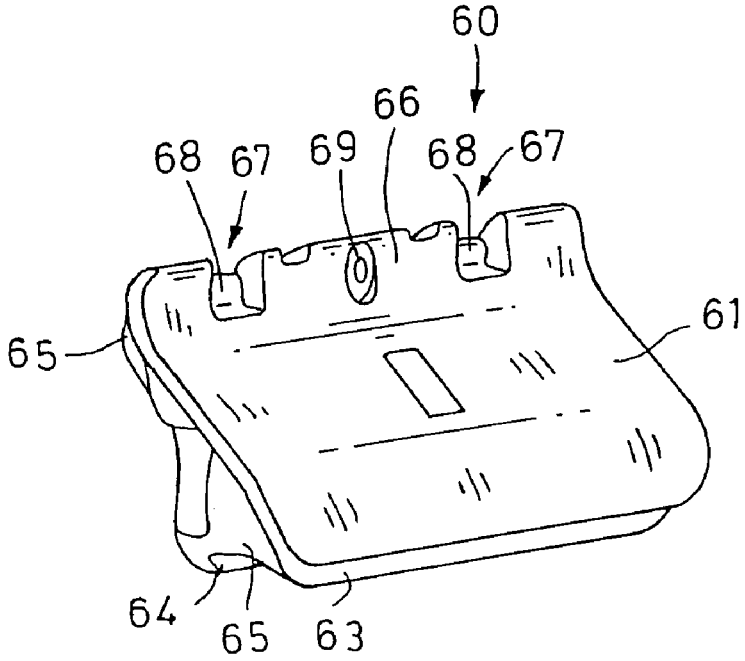
Fig.5

PLOW GUIDE FOR A CHAIN-PULLED PLOW

FIELD OF THE INVENTION

The subject matter of the present invention relates to a plow guide assembly for a chain-pulled plow. The plow guide assembly includes one or more plow guide troughs having multiple parts and being connectable to one another by coupling elements so as to be tension-proof and angularly movable. Each plow guide trough has a center piece with superposed chain guide channels. Two end pieces are joined to corresponding sides of the center piece. The end piece is preferably a single-piece casting with superposed chain channel sections that are separated by a cast sliding spacer piece.

BACKGROUND OF THE INVENTION

In underground mining operations, it is known to use plow systems which comprise a shiftable chain scraper conveyor which can be used both as a face conveyor and as a gate conveyor. On the working face side, plow guide troughs are mounted on the conveyor line pans of the chain scraper conveyor, on which plow guide troughs the plow is guided. The plow guide troughs have chain channels for guiding the endless plow chain disposed on them so as to be able to pull the plow along the wall face. In modern high-performance plow systems, to which the present invention is preferably addressed, the plow on the plow guide is forcibly guided. In the prior art, many measures have already been proposed to reinforce the conveyor line pans and the plow guide troughs so as to keep up with the ever-increasing rated capacities of the chain scraper conveyors and the plow drives in high-performance plow systems. Thus, it is known that the plow guides can be disposed on the goaf side and that the plow can be designed as a sword plow, with the sword plow extending with a sword under the chain scraper conveyor (DE 36 27 733) or reaching with a sword between the top strand and the bottom strand.

Although satisfactory, there remains a need for a plow guide with plow guide troughs on conveyor line pans suitable for use with a high performance plow system, such as the Gleithobel® plow system. Furthermore, there is a need for a plow guide that has a sufficiently high tool life, and which can be economically manufactured.

SUMMARY OF THE INVENTION

The present invention relates to a plow guide assembly and plow guide troughs particularly adapted for high-performance plow systems such as Gleithobel® plows (available from DBT GmbH) which are disposed along the working face side of conveyor line pans of a chain scraper conveyor. The present invention uses the plow guide troughs according to German Patent DE 32 44 038 A1 as a starting point. In the generic plow guide troughs, the entire conveyor line pan, including the plow guide trough, is designed to comprise three parts, i.e., a center piece and two end pieces, so as to reinforce the individual plow guide troughs and to increase the tool life of the plow system. Preferably, at least the end pieces of the plow guide troughs on the working face side are made of single-piece highly refractory castings which, in the form of welded pieces, have been welded onto the conveyor line pan and onto the center piece. In the generic plow guide troughs and conveyor line pans, both the plow guide troughs on the working face side and the conveyor bottom and the spill plate side on the goaf side are designed in three parts. As a result, the time required to mount a generic plow guide trough or a conveyor line pan is comparatively high. The coupling elements in the generic plow guide troughs are bolts which have to be inserted into bolt holes in the spill plate pieces and in the sliding spacer pieces in the end pieces of the plow guide troughs.

The present invention provides a plow guide with plow guide troughs for mounting on conveyor line pans of a high-performance Gleithobel plow system. The plow guide has a sufficiently high tool life even if the rated capacities of the plow system are high. And, the plow guide can be manufactured economically.

According to the present invention, the end pieces of the plow guide have holding pockets which have been joined by casting and which are open on the working face side. High-duty toggles can be inserted into the holding pockets, requiring only minor assembly time. Consequently, in the plow guides according to the present invention, toggle connections form the coupling elements for connecting adjoining plow guide troughs in a tension-free manner, and the three-part design of the plow guide troughs with a center piece and two end pieces is retained. The toggle connections can be inserted into holding pockets that are integrally joined to the end pieces by casting and which do not require any after treatment. To reduce costs, the center pieces can be mass-produced while the end pieces can be produced to accommodate different widths, different coupling elements, or similar requirements. By using toggle connections instead of bolt connections for the generic conveyor line pans, it is possible to considerably increase the rated capacity of the plow system, while at the same time avoiding the risk of rupturing the coupling elements.

To make the end pieces of the plow guide troughs more wear resistant, the end pieces can have a preferably circumferentially closed upper chain channel section. The upper chain channel section of one of the lateral pieces can optionally have an overlapping projection and the upper chain channel section of the other end piece can utilize a mating recess for engaging the overlapping projection. Overlapping the end pieces of adjoining plow guide troughs and conveyor line pans minimizes wear due to fine coal abrasion which can be caused by angle formations between the individual conveyor line pans. Therefore, the tool life of the plow guide and thus the tool life of the entire plow system is increased. The overlapping projection and the mating recess may be designed in the shape of a ring and preferably in the shape of a centering ring and a mating centering recess so as to seal off the upper chain guide channel for the return strand of the plow chain. The preferably circular inside cross section of the upper chain channel section further reduces the susceptibility of the end pieces to wear. In a preferred modification, no transverse forces are absorbed or transmitted with the centering ring and the centering recesses. To implement this, the centering ring can conically taper towards its front side and/or can have a chamfering on its front side while the centering recess conically tapers with increasing depth and/or is countersunk on the bottom. It is also useful if one of the end pieces has an overlapping tongue above its upper chain guide channel section or in the region abutting the upper chain guide channel section and if the other end piece has a matingly overlapping slot with which the overlapping tongue mates so as to keep the overlapping parts on the chain guide channels free from the forces acting in the transverse direction.

To further minimize the seepage and deposition of fine coal dust in the upper chain guide channel, the center pieces of the plow guide can be made of a single-piece casting with a circumferentially continuous upper chain guide channel. For the purpose of inspection and simple assembly of the return strand of the plow chain, the center pieces of at least some plow guides can be made of a casting base with an access opening to the upper chain channel section. The access opening can be closed with a detachably attached hood. In the closed position, the outer surface of the hood preferably is aligned with the outer surface of all end pieces as well as the outer surfaces of the center pieces that are made of a single-piece casting. To facilitate the accessibility to the pulling strand of the plow chain, it is especially useful if the upper chain channel section in the casting base, in which the access opening is disposed, has a bottom opening leading to the lower chain channel section, which bottom opening can be filled with an insert piece, preferably an insert screen with suitable openings for allowing fine coal to pass through. Using the insert screen can ensure that during operation of the plow system, fine coal from the otherwise closed upper chain guide channel is discharged into the lower chain guide channel. The detachable insert piece replaces the sliding spacer piece (not present in the casting base) in the region of the bottom opening, with its upper surface being suitably designed in the shape of a rounded groove. It is especially preferred if the insert piece can be inserted and locked into the bottom opening without fastening elements or screws which require the use of a tool. Thus, the insert piece can have lugs disposed on the front and rear long side, and the casting base can have pocket inserts for the lugs, which pocket inserts have edges that are open toward the bottom opening. The insert piece which is inserted with its lugs into the appropriately designed pocket slots is subsequently affixed so as to face downwardly and in the direction of travel of the plow chain. The insert piece preferably has a step disposed on the front long side. A forwardly projecting lug is formed in the center of the step. The hood has a minimum of one longitudinal crosspiece disposed on the lower surface of the hood. The crosspiece, in the assembled state, abuts the step so as to be able to affix the insert piece only by inserting the hood into the bottom opening. It is useful for the rear surface of the hood to be designed as a preferably rounded groove section for bounding the upper chain guide channel.

The hood is locked to the casting bases preferably by one or more self-locking screws which have plate-shaped caps with rectangular locking attachments and which can be inserted into indentations on the upper surface of the hood, which recesses have a rectangular cross section. The locking screws preferably have a bolt screw disposed on the underside of the cap and can be screwed with a nut to the casting base from the goaf-side rear. To avoid an unintentional detachment of the hood as a result of vibrations, the hood can have a mounting hole for a damping element disposed between two indentations.

In a particularly preferred embodiment, the three-part plow guide trough itself forms the working face side of a conveyor line pan, with a single-piece intermediate metal sheet which extends continuously through the center piece and both end pieces or a single-piece continuous conveyor bottom being joined by welding to the goaf-side rear of the plow guide trough. This configuration with an intermediate metal sheet offers the advantage that the top strand of the chain scraper conveyor for each conveyor line pan can be designed as a two-way trough. To make mounting the intermediate metal sheet easier, the rear surfaces of the center piece and the end pieces can have projecting cast-on attachments, to which the intermediate metal sheet can be joined by welding. It is also to be preferred if the bottom of the bottom strand for the line pan is an angled bottom metal sheet which is joined by welding and which extends over the entire length of the center piece and the two end pieces. To further reduce the cost, the lateral profiles for guiding the scrapers in the bottom strand of the chain scraper conveyor do not have specific design features.

To operate a plow system with the plow guides and conveyor line pans according to the present invention, it is especially useful if ribs are welded on underneath the bottom metal sheet, both on the working face side and on the goaf side, with the underside of the ribs on the goaf side preferably having a curved design so as to serve as elastic arches which make it easier for the plow guide to climb when the plow system advances. The toggle connections preferably comprise toggles with toggle heads on both toggle ends, which toggles can be prevented from falling out or being detached by providing suitable retention elements in the pocket recesses that open toward the outer surfaces of the plow guide troughs. In particular, the toggle heads of the toggles can have tongues disposed on them. The tongues on one end mate with mating slots in the pocket recesses, thus making it possible for a retention element to be disposed only on one end of the toggles.

BRIEF DESCRIPTION OF THE DRAWINGS

Additional advantages and embodiments of the plow guide according to the present invention follow from the claims and the following description of examples of conveyor line pans and troughs of a plow system which are diagrammatically represented in the drawings. In the drawings:

FIG. 4 shows a sectional view along line IV—IV seen in FIG. 1.

FIG. 5 shows a perspective view of a preferred embodiment hood which is used in some of the plow guide troughs according to the present invention.

DETAILED DESCRIPTION OF THE PREFERRED EMBODIMENTS

Figure 1:
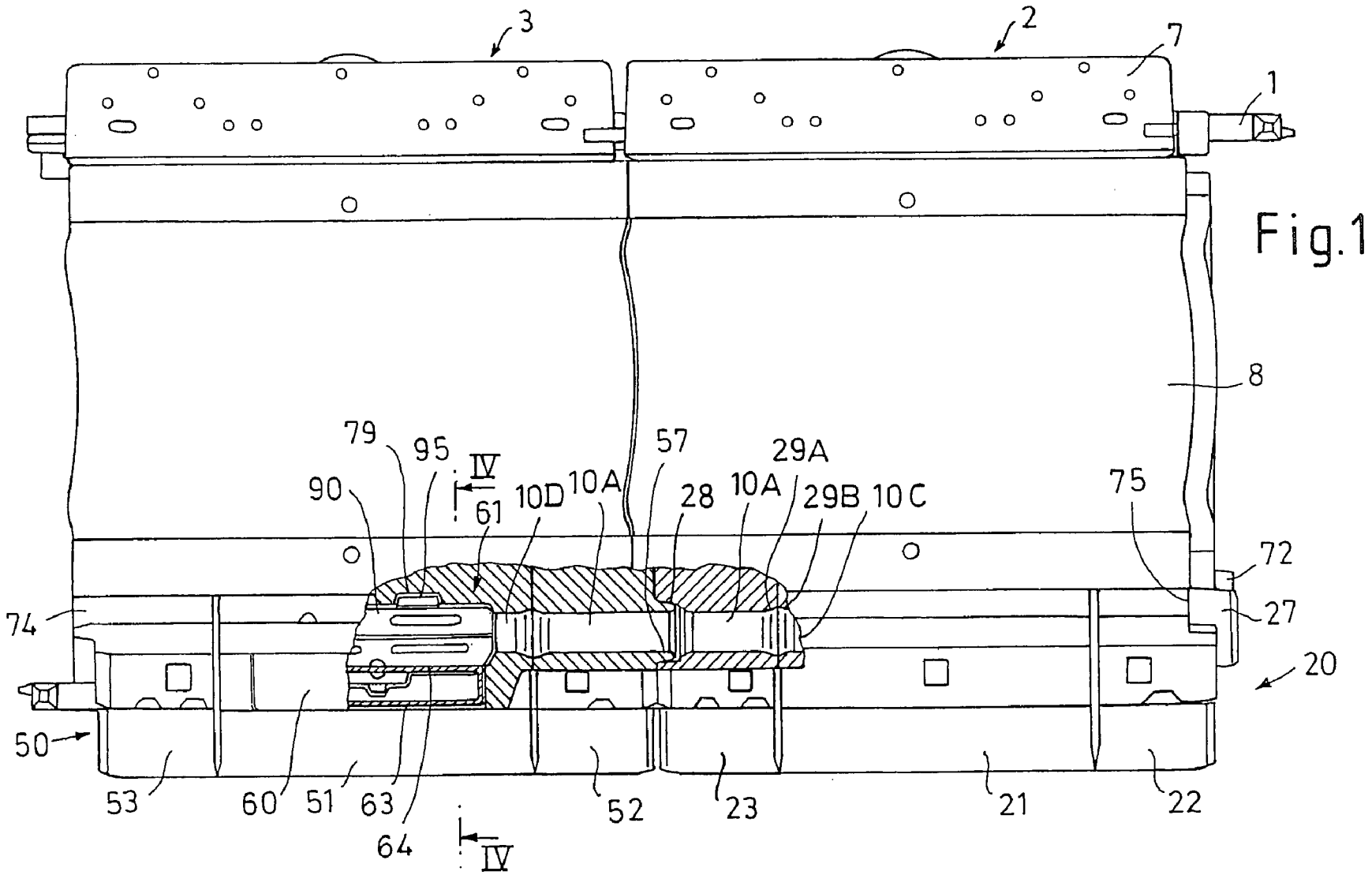
FIG. 1 shows a partially broken top view of a preferred embodiment of two plow guide troughs and conveyor line pans of a plow system in accordance with the present invention.
Figure 2:
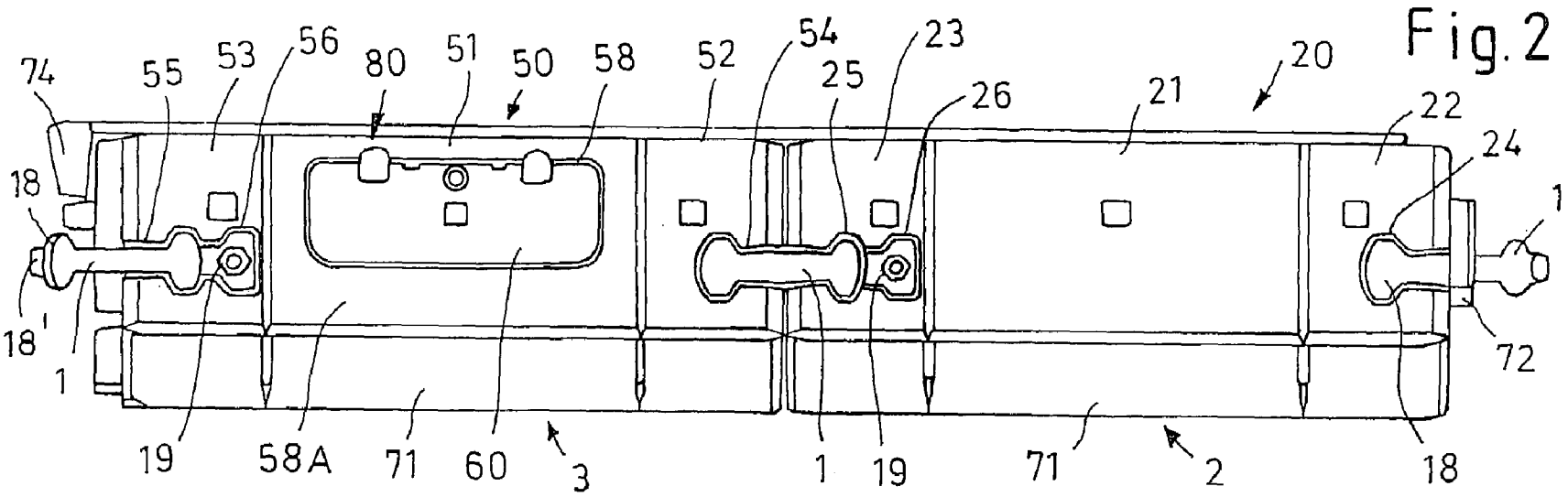
FIG. 2 shows the plow guide troughs of the plow system according to FIG. 1, with a view of the working face side of the plow system.
Figure 3:
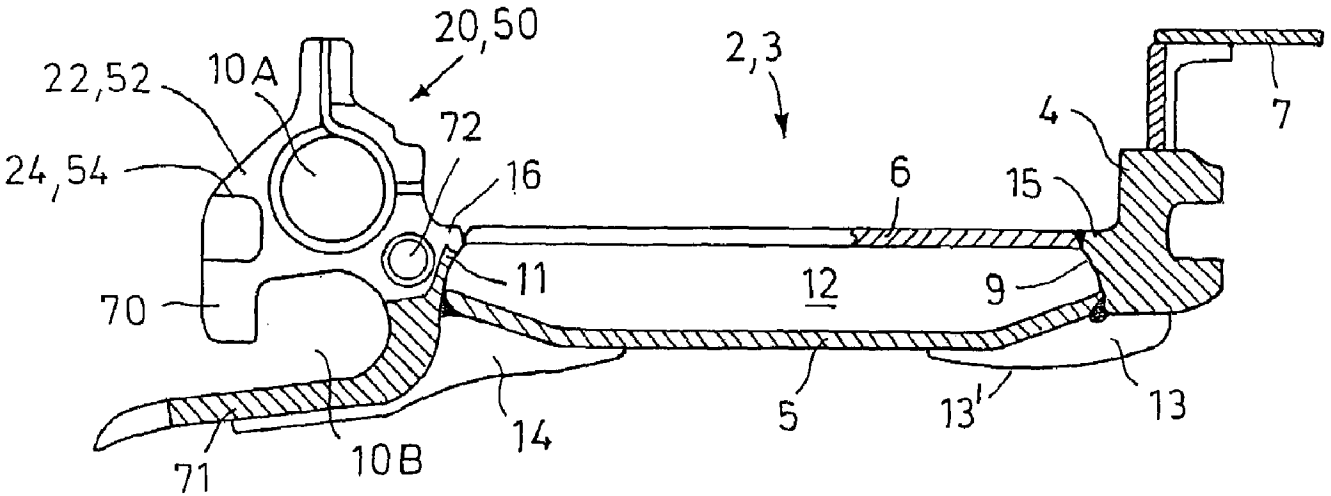
FIG. 3 shows a partially broken view of the front side of the preferred embodiment plow guide troughs according to the present invention.

FIGS. 1 and 2 show two conveyor line pans 2,3 for a plow system. The conveyor line pans are arranged side by side and are connected to one another so as to be tension-proof but angularly movable, with, in FIG. 1, the lower side of conveyor line pans 2,3. The conveyor line pans 2,3 face the working face side comprising plow guide troughs, referenced overall by reference numerals 20 and 50, on which a Gleithobel plow system (not shown in detail) is forcibly guided. Except for the differently designed plow guide troughs 20,50 on the working face side, conveyor line pans 2,3 are of identical design, as can be especially well seen in FIGS. 2 and 3. As shown in FIG. 3, each conveyor line pan 2,3 has a profiled side wall 4 on the goaf side, with attaching parts 7 projecting upwardly. The side walls 4 are connected via an angled bottom strand metal sheet 5 and an intermediate bottom 6 to plow guide troughs 20 and 50 to form a flexurally rigid structure. Intermediate bottom 6 bounds a top strand vat-holding space for holding a top strand vat, referenced overall by reference numeral 8, which top strand vat is designed as a working trough and can be removed by lifting it upwardly from conveyor line pans 2,3. Bottom strand metal sheet 5 and the inside surfaces 9 of the lateral profiles 4 and 11 of plow guide troughs 20,50 bound a bottom strand 12 for the return strand of a chain scraper conveyor (not shown in detail). Below the bottom metal sheet 5 of the bottom strand, ribs 13 are welded on the goaf side. The ribs, on their lower surface 13', are arched in a bow-like fashion so that ribs 13 not only ensure a reinforcement between bottom metal sheet 5 and lateral profile 4 on the goaf side, but also an elastic support of the plow system on the goaf side. On the working face side, additional ribs 14 are welded on below plow guide troughs 20,50 and angled bottom metal sheet 5. To make it easier to join bottom metal sheet 5 of the bottom strand and intermediate bottom 6 by welding, both lateral profiles 4 and plow guide troughs 20,50 have attachment points 15,16 or steps disposed on their inside surfaces.

The present invention relates in particular to the multipart structure of plow guide troughs 20,50 which bound conveyor line pans 2,3 on the working face side. As can be especially well seen in FIGS. 1 and 2, both the right-hand plow guide trough 20 and the left-hand plow guide trough 50 comprise three parts that are affixed, and preferably welded together. Both plow guide troughs 20,50 have a long center piece 21,51, to which, on both ends, end pieces 22,23 and 52,53 are secured and preferably welded on. The end pieces are made of castings with integrally cast-on toggle holding pockets 24,25 and 54,55. Plow guide troughs 20 and 50 differ only as to the design of their center piece 21 and 51, respectively, while end pieces 22 and 52 and 23 and 53, respectively, which are made of castings, are identically designed. End pieces 22 and 52 have toggle holding pocket halves 24 and 54 with undercuttings on the butt joints. In the undercuttings, the left (as seen in the figures) head 18 of toggle 1 can be form-fittingly anchored with its associated toggle head tongue 18' without the need of other retention elements. The respectively other toggle holding pocket half 25 and 55 comprises a pocket extension 26 and 56 for a detachable toggle retention element 19 which extends over the tongue on the other toggle head.

As is shown in FIGS. 1, 3 and 4 by way of an example, both the end pieces 22,52,23,53 and the center pieces 21,51 of plow guide troughs 20 and 50 have an upper chain channel 10A, 10C and 10D for the return strand of the plow traction chain and a lower chain channel 10B for the pulling strand of the plow chain. The lower chain channel 10B is open toward the face so that a plow (not shown in detail) can be forcibly guided on slide rail 70 of plow guide troughs 20,50—which slide rail bounds the lower chain channel 10B on the face side—by means of arm attachments which engage in the lower chain channel 10B where they are connected to the pulling strand of the plow chain. At the same time, the Gleithobel runs on slideway 71 which on all plow guide troughs 20,50 projects beyond slide rail 70 on the face side.

FIG. 3 also clearly shows that the upper chain guide channel 10A has a circular cross section and is circumferentially closed. As FIGS. 1 through 3 also show, end pieces 22,52 of plow guide troughs 20 and 50 have centering pins 72 which project beyond the front sides of end pieces 22,52 and which can engage in mating centering recesses on end pieces 23 and 53 of the plow guide troughs. End pieces 22 and 52 each have a sliding spacer piece such as centering rings 27 and 57, respectively. The centering ring projects beyond the front side and tapers conically toward its tip and mates with a correspondingly designed centering recess 28 in end pieces 23 and 53. The centering recess tapers conically as its depth increases. The conically tapering centering ring 27,57 has a chamfering defined on its front end. The conically tapering centering recess 28 is matingly countersunk. Between centering ring 57 and centering recess 28, sealing surfaces form. The sealing surfaces prevent coal dust from entering or exiting along the joint between the conveyor line pans. Centering rings 27 and 57 form an extension of the upper chain channel section 10A that projects beyond the associated end piece 22 and 52, respectively, so that when angles form along the joint between two neighboring plow guide troughs 20,50 in the region of the upper chain channel 10A, it is not possible for fine coal to enter between plow guide troughs 20 and 50. Transverse forces between conveyor line pans 2,3 and plow guide troughs 20,50 are preferably not transmitted by way of mating centering rings 27,57 and centering recesses 28 but exclusively by way of centering pins 72 and the mating recesses and by way of overlapping tongues 74 and overlapping slots 75 above the upper chain guide channel 10A.

As FIG. 1 indicates, the two conveyor line pans 2,3 differ only as to the construction and design of the center pieces 21 and 51 for plow guide trough 20 and 50. Center piece 21 is a casting with a cross section that is constant throughout its length, defines a circumferentially closed upper chain guide channel 10C, with conical or chamfered circular expansions 29A and 29B being disposed along the transition region from the upper chain channel sections 10A of the side pieces 22,23 to the chain guide channel 10C in the center piece 21. The expansions ensure that along the welded joint between end pieces 22,23 and center piece 21, the plow chain can travel without touching abutted edges even in the presence of mounting inaccuracies.

Center pieces 51 differ from center pieces 21 in that center piece 51 has an access opening 58 in the front section 58A—facing the working face side—of a casting base 59, which front section forms a loading ramp. Via access opening 58, the return strand of the plow chain, which return strand is installed in the upper chain guide channel 10D, 10A, can be accessed. The opening 58 is closed by means of a hood 60 which is anchored in opening 58 by means of two locking screws 80. As seen in FIGS. 1 and 4, access opening 58 also leads to an access to the lower chain guide channel 10B since, in addition to access opening 58 in the loading ramp, casting base 59 also has a bottom opening 78 in the transition region from upper chain channel 10D to lower chain channel 10B. Bottom opening 78 is closed by means of an insert piece 90 which is designed as an insert screen.

The design of casting base 59, hood 60, locking screws 80 and insert screen 90 will be explained below in greater detail with reference to FIGS. 4 through 8. On front side 61, hood 60 which is perspectively shown in FIG. 5 has a curved design which corresponds to the curvature of front side 58A of center piece 51, which front side serves as a loading ramp, while rear side 62 of the hood is circularly curved so as to complement the circular shape of the upper chain channel 10D in center piece 51. On the lower side, hood 60 has two longitudinal crosspieces 63,64, the distance between which is greater than the depth of slide rail 70 (FIG. 4). The anterior longitudinal crosspiece 63 abuts a longitudinal ledge 76 disposed on the upper side of slide rail 70. As a result, the hood 60 in opening 57 is locked against horizontal movements perpendicular to the direction of chain travel. The rear longitudinal ledge 64 rests on lug 91 which faces the working face side and which is located in the center of insert screen 90. As a result, the insert screen 90 is affixed on the working face side in opening 78. As especially well seen in FIG. 7, lug 91 is an extension of step 99 on the front side 98 of insert screen 90 and is set off against upper side 92 of insert screen 90, which upper side is curved in a groove-like manner.

Figure 8:
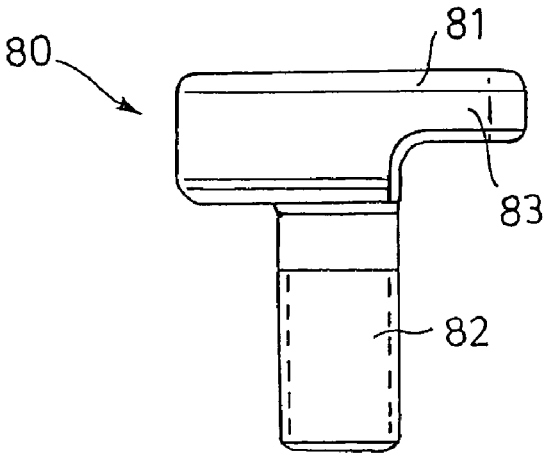
FIG. 8 shows a lateral view of a detail of the locking screw used to affix the hood.

In the upward direction, rear side 62 of hood 60 ends in a rounded lug 65 which extends along the entire length of hood 60 and above which stop ledge 66 for detachably locking hood 60 in opening 58 is disposed. Stop ledge 66 has two rectangular indentations 67 disposed in it, which indentations mate with one locking lug 83 each. The locking lug 83 has a rectangular cross section and projects laterally beyond screw bolt 82, of caps 81 of locking screws 80 (FIG. 8). Locking lugs 83 are tightened against the front side of casting base 59 by use of nuts 84. The nuts 84, from the goaf side, are screwed onto screw bolts 82 that pass through the holes in casting base 59 in the region of indentations 67, with the bottom sections 68 of indentations 67 being clamped between locking nuts 83 on caps 81 of locking screws 80 and the front side of casting base 59 so as to anchor hood 60 in its upper locking ledge 66 as well. To protect locking screws 80 and the hood fastener, casting base 59 ends in rail 77, the cross section of which has the shape of a T. At the midpoint between the two indentations 67, hood 60 also has a mounting hole 69 for a damping element (not shown in detail).

Figure 6:
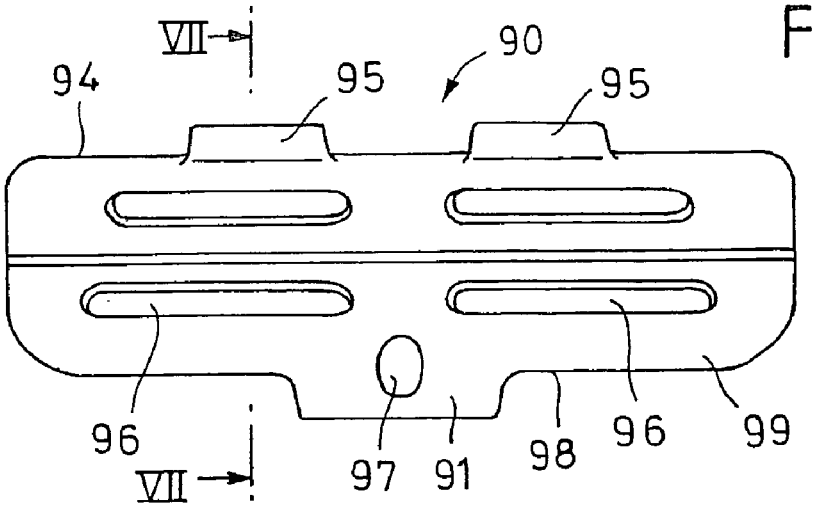
FIG. 6 shows a plan view of a preferred embodiment insert screen which can be inserted into the center piece in plow guide troughs having an opening.
Figure 7:
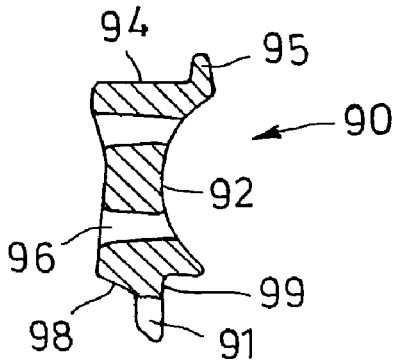
FIG. 7 shows a sectional view along line VII—VII seen in FIG. 6.

Insert screen 90 is shown in detail in FIGS. 6 and 7 and can be detachably anchored without additional screw fasteners in bottom opening 78 of casting base 59. In addition to step 99 and central lug 91 which are pushed against the downwardly tapering bounding wall of the bottom opening by one of the longitudinal ledges of the hood, insert piece 90 has two additional lugs 95 disposed on its goaf-side rear side 94. The lugs, on the upper end of the groove-shaped upper side 92, project backwardly. Furthermore, insert screen 90 has longitudinal slots 96 which form open passages for discharging fine coal dust from the upper chain guide channel. And in lug 91, the insert screen has opening 97 for engaging a tool for mounting and dismounting insert screen 90.

FIG. 1 shows that insert screen 90 with its goaf-side lugs 95 is seated in open-edged pocket slots 79, with lugs 95 being engaged in pocket slots 79 in such a way that in the mounted state, insert screen 90 is secured on the goaf side against vertical movements and axial movements in the direction of travel of the plow chain.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A plow guide assembly for a chain-pulled plow, the assembly including a plurality of plow guides, each plow guide being connectable to one another by means of coupling elements so as to be angularly movable, each plow guide comprising a center piece defining superposed chain guide channels, to both sides of which the center piece and an end piece are joined thereto, which end piece is a single-piece casting with superposed chain channel sections that are separated by a sliding spacer piece, wherein the end pieces define holding pockets for toggle connections as coupling elements, which holding pockets are open on a working face side.

2. The plow guide assembly as claimed in claim 1, wherein the end pieces each define a circumferentially closed upper chain channel section, with the upper chain channel section of one of the end pieces having an overlapping projection; and with the upper chain channel section of the other end piece defining a mating recess.

3. The plow guide assembly as claimed in claim 2, wherein the overlapping projection and the recess are circularly shaped and are in the form of a centering ring and a centering recess.

4. The plow guide assembly as claimed in claim 3, wherein the centering ring features at least one of (i) a taper conically towards its front side and (ii) a chamfer on its front side and that, with increasing depth, the centering recess features at least one of (i) a conical taper and (ii) a countersunk bottom.

5. The plow guide assembly as claimed in claim 1, wherein one of the end pieces has an overlapping tongue disposed above its upper chain channel section or in the region abutting the upper chain channel section and that the other end piece has a mating overlapping slot.

6. The plow guide assembly as claimed in claim 1, wherein the center piece is a single-piece casting defining a circumferentially closed upper chain guide channel.

7. The plow guide assembly as claimed in claim 1, wherein the center piece includes a casting base defining an access opening providing access to the chain guide channel, which opening can be closed by use of a detachably affixed hood.

8. The plow guide assembly as claimed in claim 7, wherein the casting base defines a bottom opening between the upper chain guide channel section and the lower chain guide channel section, which bottom opening can be filled by an insert piece.

9. The plow guide assembly as claimed in claim 8, wherein the upper side of the insert piece has the shape of a rounded groove.

10. The plow guide assembly as claimed in claim 8, wherein the insert piece has projecting lugs disposed on the front and rear long side and the casting base defines pocket slots for the lugs.

11. The plow guide assembly as claimed in claim 8, wherein the insert piece defines a step disposed on the front long side, on the center of which step a forwardly projecting lug is disposed.

12. The plow guide assembly as claimed in claim 8, wherein the hood has at least one of features (i) and (ii): (i) the rear side of the hood has a rounded section to bound the upper chain guide channel, and (ii) the lower side of the hood has at least one longitudinal crosspiece disposed on it, which longitudinal crosspiece, in the mounted state, abuts the step of the insert piece so as to mount the insert piece on the bottom opening.

13. The plow guide assembly as claimed in claim 7, wherein the hood has indentations on the upper side of the hood, into which indentations the locking lugs on caps of locking screws can be inserted, which locking screws have a screw bolt on the lower side of the caps and can be screwed from the working face side to the casting base by means of a nut.

14. The plow guide assembly as claimed in claim 7, wherein the hood defines two indentations and a mounting hole adapted for receiving a damping element between the two indentations.

15. The plow guide assembly as claimed in claim 1, wherein the rear side of the center piece and the end pieces includes cast-on projecting attachments adapted for joining an intermediate metal sheet by welding thereon.

16. The plow guide assembly as claimed in claim 1, the plow guide assembly further comprising toggle connections, the toggle connections including toggles with toggle heads on both toggle ends.

17. The plow guide assembly of claim 1 further comprising:

a single-piece metal sheet disposed along and extending continuously along the center piece and the end pieces.

18. The plow guide assembly of claim 1 further comprising:

a continuous conveyor bottom disposed along and welded to the goaf-side rear side of at least one plow guide.

19. The plow guide assembly of claim 1 further comprising:

an angled, one-piece, metal sheet extending along the center piece and the two end pieces of at least one plow guide.

20. The plow guide assembly of claim 19 further comprising:

a plurality of ribs welded to the metal sheet.

21. A plow guide adapted for use with a chain-pulled plow, the plow guide comprising:

a first end piece having a first side and a second, opposite side, the first end piece defining a first chain channel extending between the first and second sides of the first end piece;

a second end piece having a first side and a second, opposite side, the second end piece defining a second chain channel extending between the first and second sides of the second end piece;

a center piece having a first side and a second, opposite side, the center piece defining a third chain channel extending between the first and second sides of the center piece, the center piece disposed between and adjoined to the first end piece and the second end piece, each of the first chain channel, the second chain channel, and the third chain channel being aligned with another;

wherein each of the first end piece and the second end piece define, along one of the first and second sides, a holding pocket adapted to receive a toggle coupling element for connecting the plow guide with an adjacent plow guide.

22. The plow guide of claim 21 wherein the center piece defines an access opening to the third chain channel defined in the center piece, the center piece further having a detachable hood adapted to close the access opening.

23. The plow guide of claim 21 further comprising:

a first sliding spacer piece disposed between the first chain channel and the third chain channel.

24. The plow guide of claim 23 further comprising:

a second sliding spacer piece disposed between the second chain channel and the third chain channel.

25. The plow guide of claim 21 wherein the center piece further defines a fourth chain channel extending between the first and second sides of the center piece.

26. The plow guide of claim 25 wherein the center piece further defines an opening providing access between the third and fourth chain channels.

27. The plow guide of claim 26 further comprising:

an insert screen detachably secured within the access.

* * * * *